US006182793B1

(12) United States Patent
Jamison

(10) Patent No.: US 6,182,793 B1
(45) Date of Patent: Feb. 6, 2001

(54) LUBRICANT DELIVERY SYSTEM FOR LUBRICATING RAIL WHEEL FLANGES

(75) Inventor: Warren E. Jamison, Edmonds, WA (US)

(73) Assignee: Warren Jamison, Edmonds, WA (US)

( * ) Notice: Under 35 U.S.C. 154(b), the term of this patent shall be extended for 0 days.

(21) Appl. No.: 09/291,446

(22) Filed: Apr. 13, 1999

(51) Int. Cl.[7] ..... B61K 3/02
(52) U.S. Cl. ..... 184/3.2; 222/129
(58) Field of Search ..... 184/3.2; 222/129

(56) References Cited

U.S. PATENT DOCUMENTS

| | | | | |
|---|---|---|---|---|
| 1,883,787 | * | 10/1932 | Head et al. | 222/129 |
| 2,356,200 | * | 8/1944 | Bedard | 222/129 |
| 2,516,174 | * | 7/1950 | Baumgard | 222/129 |
| 2,885,029 | * | 5/1959 | Burrell | 184/3.2 |
| 2,935,159 | * | 5/1960 | Burrell | 184/3.2 |
| 3,144,915 | * | 8/1964 | Burrell | 184/3.2 |
| 3,165,171 | * | 1/1965 | Baeriswyl | 184/3.2 |
| 3,760,904 | * | 9/1973 | Luthar | 184/3.2 |
| 3,944,025 | * | 3/1976 | Owen | 184/3.2 |
| 4,711,320 | * | 12/1987 | Dombroski et al. | 184/3.2 |
| 4,763,759 | * | 8/1988 | Federico | 184/3.2 |
| 4,930,600 | * | 6/1990 | Kumar et al. | 184/3.2 |
| 5,337,860 | * | 8/1994 | Burke et al. | 184/3.2 |
| 5,341,957 | * | 8/1994 | Sizemore | 222/129.1 |
| 5,380,469 | * | 1/1995 | Flider | 252/565 |
| 5,597,051 | * | 1/1997 | Moriya et al. | 184/6.1 |
| 5,778,761 | * | 7/1998 | Miller | 222/129.1 |

OTHER PUBLICATIONS

Anonymous; "Soybean Oil Finding Niche in Rail Lubrication Market"; Railway Track & Structures, Feb. 2000.*

Anonymous; "AG–Based Industrial Lubricants Research program (ABIL)"; <www.uni.edu/abil/about.html>.*

Anonymous; "Soy Based Lube Reduces Friction"; Hydraulic & Pneumatics, Oct. 1998.*

Lou Honary, Randy Boeckenstedt; "Making a Case for Soy–based Lubricants"; Lubrication Engineering, Jul. 1998.*

Anonynous; "ABIL releases new product: Soy–Trak"; Abil News, Jul. 1998.*

* cited by examiner

*Primary Examiner*—David A. Bucci
*Assistant Examiner*—Chong H. Kim
(74) *Attorney, Agent, or Firm*—Ronald M. Anderson

(57) ABSTRACT

A lubrication system for automatically applying a viscous fluid lubricant to the wheel flanges of locomotives and/or rail cars. The lubricant reduces friction and wear at the interface between the wheel flanges and the sides of rails. The viscosity of the lubricant is sufficient to ensure that the lubricant does not migrate to undesirable locations, such as onto the crown of the rails. The system delivers lubricant to both sides of the train from a containers holding sufficient lubricant to last throughout the standard maintenance cycle of a long haul locomotive. The lubrication is delivered at a flow rate controlled as a function of a rotational speed of the wheels of the locomotive. The system can also be adapted to control the rate of flow of lubricant delivered to the wheel flanges in response to other criteria. Since the lubricant is derived from soybeans, it is non-toxic and biodegradable. The lubricant containers, motor control, and pump are configured in a space saving array that can be disposed within a nose or central location within a locomotive. The lubricant applicators are mounted with fixed brackets on the trucks of locomotives having wheels rotating on tapered roller bearings, or with pivotal brackets that allow for some lateral movement on locomotives having wheels rotating on cylindrical roller bearings.

31 Claims, 4 Drawing Sheets

LUBRICANT DELIVERY SYSTEM FOR LUBRICATING RAIL WHEEL FLANGES

FIELD OF THE INVENTION

The present invention generally relates to a lubrication system and method for applying a lubricant to the wheels of a vehicle that runs on tracks, and more specifically, to a lubrication system and method for automatically applying a viscous fluid lubricant to the flanges of the rail wheels.

BACKGROUND OF THE INVENTION

Evidence of the need for lubricating the flanges of rail wheels is audibly evident when a train travels around a curved section of track. The sound of the flanges of each wheel of the train rubbing against the sides of the rails is normally very audible as a high-pitched "squealing" sound. Of greater importance than the annoying sound this action produces is the wear on the rails and the wheels that results from the friction between these components. A common cure for friction between two rubbing surfaces and the wear that results is the application of a lubricant to the surfaces. However, in the case of rail wheels and tracks, care must be taken not to apply a lubricant to the interface between the crown of the rails and the rolling surfaces of the driving wheels of a locomotive, since friction is required at this interface to drive the locomotive forward, particularly on grades. Even if the lubricant is applied only to the flanges of the wheels, it may creep onto the rolling surfaces, where it is not needed or desired.

U.S. Pat No. 4,915,856 discloses a solid lubricant composition that can be formed into strands, blocks, or rods of lubricant. An applicator applies the solid lubricant to the rail wheels by rubbing it onto the flanges of the wheels. The solid lubricant transfers to the sides of the rails and from thence onto the side of following rail wheels, thereby lubricating the wheel flanges of substantially all of the cars in a train. Due to its high viscosity, the solid lubricant does not creep onto the adjacent surfaces of the wheels, where it is not desired. As a practical matter, the lubricant is typically applied to the wheel flanges of a locomotive at the front of a train.

One of the problems with the solid lubricant disclosed in the above-noted patent is that only a relatively limited amount of the material can conveniently be held in an applicator mounted adjacent to the wheel flange. The rate of application is sufficiently great that the solid lubricant supply is relatively quickly consumed. For short haul locomotives and light rail commuter trains, this limited quantity of the solid lubricant that is available to be applied is not such a problem, since the maintenance intervals on such trains are typically only a few days or weeks. Also, short haul trains are more readily available for servicing, during which the supply of solid lubricant in an applicator can readily be replenished. In contrast, long haul trains of the type that carry freight across the country, operate with a much longer maintenance interval, e.g., with scheduled maintenance occurring about every 92 days. Replenishing a solid lubricant block or rod in an applicator every few days is simply not practical on a long haul locomotive.

Ideally, it would be desirable to apply a lubricant to wheel flanges on the wheels of a locomotive at a rate that is determined by the rolling speed of the wheels. By controlling the rate of application as a function of train speed, it should be possible to meter the application of the lubricant to the wheel flanges in a manner that applies only the amount of lubricant required. Clearly, sufficient wheel flange lubricant to last for the entire normal maintenance interval cannot be contained within an applicator mounted under a locomotive. Instead, a different type of lubricant will be required, the lubricant must be stored in a compartment on the locomotive rather than under it, and the lubricant must be applied in a novel manner that ensures the wheel flanges are properly lubricated the entire time that the train is in operation. To ensure adequate lubrication is applied to transfer to the wheel flanges of other railcars in the train, it will be preferable to apply the lubricant to a plurality of wheel flanges on both sides of the trains, but from a single supply source, thereby simplifying the replenishment of the supply of lubricant, when needed.

SUMMARY OF THE INVENTION

In accord with the present invention, a system is provided for applying a lubricant to a rail wheel flange of a rail wheel that rolls along a track. The system includes a container of the lubricant and a pump having an inlet port and outlet port. The inlet port of the pump is coupled in fluid communication with the container. An applicator is mounted adjacent to the rail wheel flange and is connected in fluid communication with the outlet port of the pump. Preferably, an electric motor, or other prime mover, is drivingly connected to the pump, to apply a driving force that causes the pump to draw the lubricant from the container. The lubricant is forced through the applicator onto the rail wheel flange, thereby lubricating it to reduce friction and wear between the rail wheel flange and a side of the track.

Preferably, additional containers of the lubricant are provided and are also connected in fluid communication with the inlet port of the pump. The number of additional containers of lubricant is sufficient to provide adequate lubrication for a standard maintenance interval of a rail vehicle on which the system is disposed. In the preferred form of the invention, each container comprises a collapsible, flexible bag disposed within a box.

The containers are disposed at a plurality of different elevations, so that lubricant in a container that is at a lower elevation is preferably drawn by the pump and applied to the rail wheel flange before lubricant in a container that is at a higher elevation. Additional applicators that are preferably coupled in fluid communication with the outlet port of the pump and are mounted adjacent other rail wheel flanges to which the lubricant is applied. In the preferred form of the invention, a fluid distributor sequentially directs lubricant from the pump to each applicator in succession.

Also preferably provided in the system is a connector that is adapted to couple to a wheel speed sensor used on the locomotive to monitor a rotational speed of a rail wheel, as the wheel rolls along the track. The wheel speed sensor produces a signal indicative of the rotational speed of the rail wheel. A controller is coupled to the prime mover and to the connector and is employed to control a rotational speed of the prime mover in response to the signal indicative of the rotational speed of the rail wheel flange. The pump is thereby driven by the prime mover at a speed proportional to the rotational speed of the rail wheel. As a result, the lubricant is applied to the rail wheel flange at a flow rate proportional to the wheel's rotational speed.

Typically, the applicator is mounted under a locomotive and applies the lubricant to the rail wheel flange of a rail wheel mounted on the locomotive. In addition, the applicators are adapted to mount a front end and a rear end of the locomotive and to apply the lubricant to the rail wheel flanges of at least one rail wheel mounted adjacent thereto.

The applicators are used in pairs, such that when one applicator of a pair is mounted to apply lubricant to a rail wheel flange on one side of the locomotive, a second applicator of the pair is mounted to apply lubricant to the rail wheel flange on an opposite side of the locomotive.

In one version, a fixed mounting bracket is provided that is adapted to mount the applicator on a locomotive having rail wheels turning on tapered roller bearings. In a different version, a mounting bracket is employed that allows for lateral movement of the applicator and is adapted to mount the applicator on a locomotives having rail wheels turning on cylindrical roller bearings.

Another aspect of the present invention is directed at a method for lubricating a rail wheel flange of a rail wheel that rolls along a track, during an extended predefined maintenance interval. The method includes steps that are generally consistent with the functions implemented by the elements of the system discussed above.

BRIEF DESCRIPTION OF THE DRAWING FIGURES

The foregoing aspects and many of the attendant advantages of this invention will become more readily appreciated as the same becomes better understood by reference to the following detailed description, when taken in conjunction with the accompanying drawings, wherein.

DESCRIPTION OF THE PREFERRED EMBODIMENT

Figure 1:
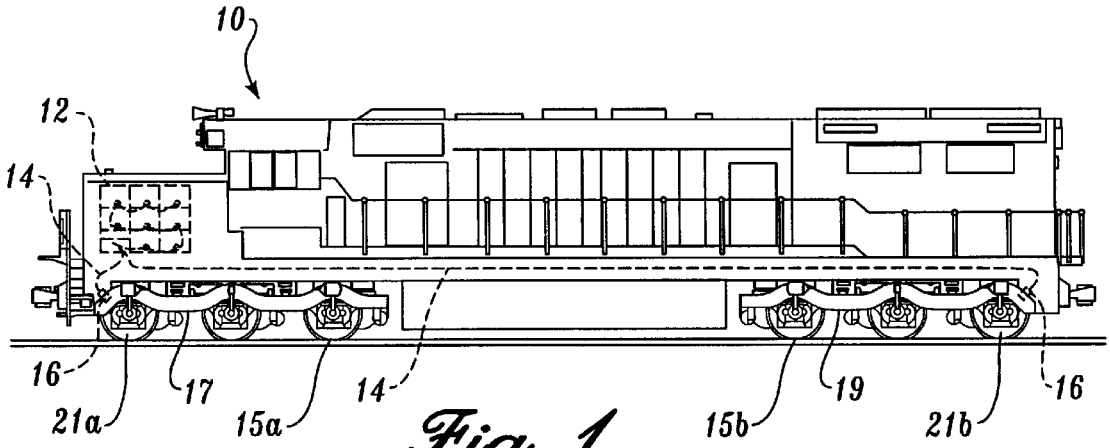
FIG. 1 is a schematic view of the lubrication system mounted in an internal compartment of a locomotive.

FIG. 1 illustrates a lubrication system preferably mounted on a locomotive 10 to apply lubricant to the leading and trailing wheels of the locomotive. A lubricant supply array and pump 12 are mounted within the interior of locomotive 10, e.g., within a utility compartment of the forward section. Supply lines 14 are in fluid communication with lubricant supply array and pump 12 and lead to applicators 16, which are mounted on a front truck 17 and a rear truck 19, preferably adjacent to leading wheels 21*a* and trailing wheels 21*b* of locomotive 10.

While not shown, it is contemplated that lubricant supply array and pump 12 can be mounted in a more centrally disposed compartment of locomotive 10, rather than in the forward section, as shown in FIG. 1. A central location would significantly reduce the length of supply line 14 from lubricant supply array and pump 12 to rear truck 19.

Alternatively, if space does not permit the applicators to be mounted adjacent to leading wheels 21*a* and trailing wheels 21*b*, they can be mounted adjacent to wheels 15*a* and 15*b*. Mounting applicators 16 adjacent to wheels 15*a* and 15*b* will result in substantially shorter supply line 14 leading to the applicators respectively mounted on front truck 17 and rear truck 19 from a centrally located lubricant supply array and pump 12, as discussed above. However, the alternative mounting location for the applicators does not provide any lubrication to the front two rail wheels of front truck 17 and is therefore not preferred. Further, it is also possible to mount applicators adjacent to the wheel flanges on rail cars other than the locomotive, to provide additional lubrication, or as an alternative. The central supply of lubricant will then likely be disposed within any rail car having wheel flanges that are thus lubricated.

It should be noted that as applicators 16 apply lubricant to their respective rail wheels, the lubricant is transferred from the rail wheel flange to the side of the rails. The rail wheel flanges on the locomotive of a train are lubricated by the present invention, and as the train proceeds along a track, the rail wheel flanges on the cars pulled by the locomotive benefit from lubricant that has been transferred from the lubricated rail wheel flanges and deposited on the sides of the rails. As a result, lubricating only selected rail wheels on the locomotive at the front of a train can provide lubrication to substantially all of the rail wheel flanges on the rail cars in a train as the wheels roll along the lubricated rails.

The lubricant applied to the wheel flanges should be sufficiently viscous and tacky so as to adhere to the sides of the rails and not migrate from the sides the rails onto the crown of the rails. Lubricant flung from the wheels onto the road bed of the tracks is lost and provides no lubrication benefit. While a nontoxic and biodegradable lubricant such as that used in the present invention will not harmfully pollute the environment, the loss of the lubricant in this manner represents an inefficient use that will lead to higher operating costs. Migration of the lubricant onto the crown of the rails from the sides is very undesirable, since the driving wheels of the locomotive require friction, not lubrication, at the crown/rail wheel interface particularly when the locomotive is pulling the train up even a slight grade.

Accordingly, in addition to being non-toxic, biodegradable, environmentally friendly, and not requiring any special waste disposal practices, the lubricant used in the present invention has good lubricating properties, and has a characteristic tackiness and viscosity. This lubricant is not readily flung off the wheels due to centrifugal force, but instead, preferentially adheres to the rail wheel flanges and the side of the rails, with virtually no migration onto other surfaces. Prior art lubricating systems have employed solid lubricants that also provided many of these requirements. However, as noted above in the Background of the Invention, prior art solid lubricants are difficult to store in an applicator in sufficient quantity to provide lubrication to rail wheel flanges for an extended period of time, without need for inconveniently frequent re-supply. To address the problems of supply, the preferred lubricant used in the present invention is a liquid made from soybeans and has a viscosity greater than 20,000 Centistokes. This liquid lubricant can be stored in large quantities in a single, central location and delivered as required to the rail flanges by appropriate applicators, as noted above.

Figure 2:
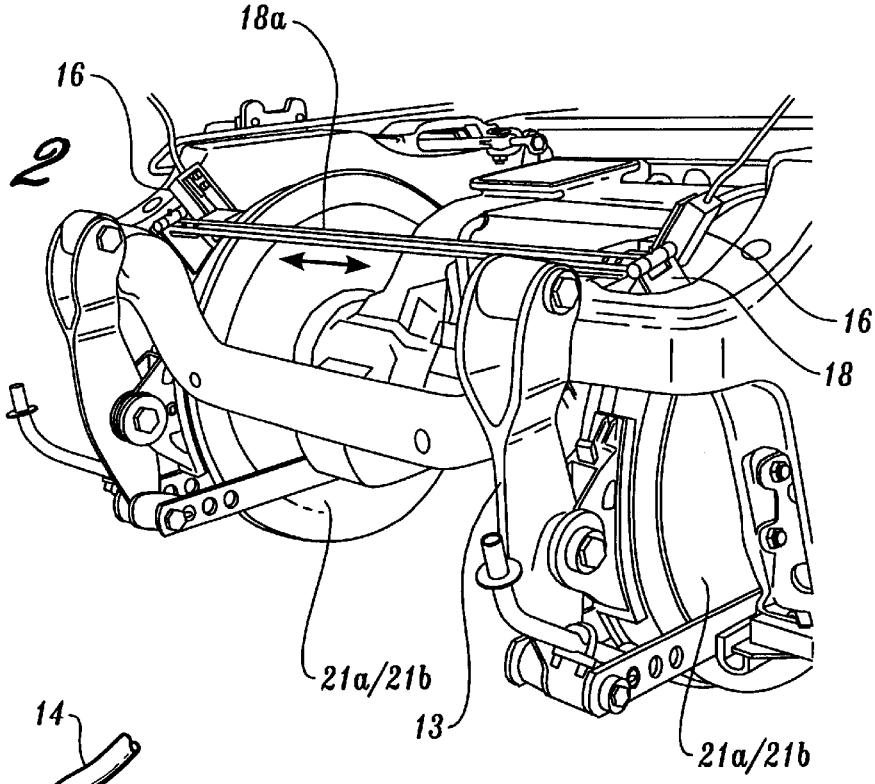
FIG. 2 is a schematic view of paired applicators mounted to brackets that allow for lateral movement, as required for use on locomotives having cylindrical roller axle wheel bearings.

FIG. 2 illustrates a preferred arrangement for mounting applicators 16 on a truck assembly 13 in pairs, adjacent wheels 21*a* or 21*b*, so that lubrication is provided to the wheels on both sides of the truck assembly. Preferably, truck assembly 13 is disposed under locomotive 10, but may instead be the truck assembly on any rail car using the present invention for directly applying the lubricant to the wheel flanges of that rail car. Very long trains transiting a route that has many curves may benefit from having additional lubricant applicators 16 mounted on rail cars near the center of the train. FIG. 2 illustrates that no matter whether truck assembly 13 is mounted under locomotive 10, or on a rail car, applicators 16 provide the most benefit when used in pairs, so that rail wheels disposed on both sides of the truck assembly are lubricated.

Note that a bracket assembly 18 for mounting two applicators 16 at opposite sides of truck assembly 13 includes a bar 18*a* that couples the two applicator. Bracket assembly 18 is pivotally mounted to the truck assembly and enables lateral movement of the two applicators from side-to-side of truck assembly 13, while maintaining a constant spacing between the applicators. Thus bracket assembly 18 is particularly well suited to be used on locomotives that use cylindrical axle roller bearings for mounting the rail wheels. Older locomotives make use of these cylindrical axle roller bearings, which allow the rail wheels a small amount of lateral motion along the longitudinal axis of the axle. To accommodate this lateral movement of the rail wheels, bracket assembly 18 must also permit lateral movement of the applicators. If the bracket assembly did not track this lateral movement, the applicators would be damaged by forceful contact with the wheel flanges, as the wheels move from side to side while rolling on the rails. Bracket assembly 18 is fully described in U.S. Pat. No. 5,337,860, the drawings and disclosure of which are hereby specifically incorporated herein by reference.

Figure 3:
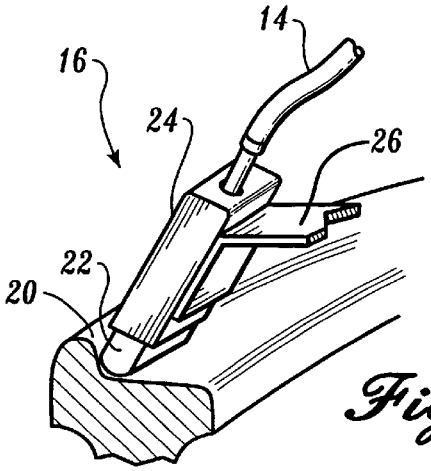
FIG. 3 is a schematic view of an applicator applying lubricant to the flange of a rail wheel.

While not shown in detail in FIG. 3, a fixed bracket assembly 26 formed of an angled sheet metal plate is used for mounting the applicator on locomotives that use tapered axle roller bearings. Newer locomotives make use of these tapered axle roller bearings, which do not allow the lateral movement described in association with cylindrical axle roller bearings. Such a fixed bracket assembly is fully described in U.S. Pat. No. 5,251,724, the drawings and specification of which are hereby specifically incorporated herein by reference. Thus, the system of the invention may be used with virtually all of the rolling locomotive and railcar stock in use today, regardless of the type of wheel bearings employed. It will also be apparent that the fixed bracket assembly may be fabricated in various configurations to attach to an appropriate portion of the truck assembly, regardless of the design thereof, so that a nose piece 22 is disposed adjacent to a wheel flange 20 so as to enable the lubricant to be applied thereto by the nose piece.

FIG. 3 illustrates how applicator 16 is disposed for applying lubricant to rail wheel flange 20. Supply line 14 is in fluid communication with the lubricant supply array and pump 12 of FIG. 1. A housing 24 secures nose piece 22 on the applicator to direct the flow of lubricant onto rail wheel flange 20.

Figure 4:
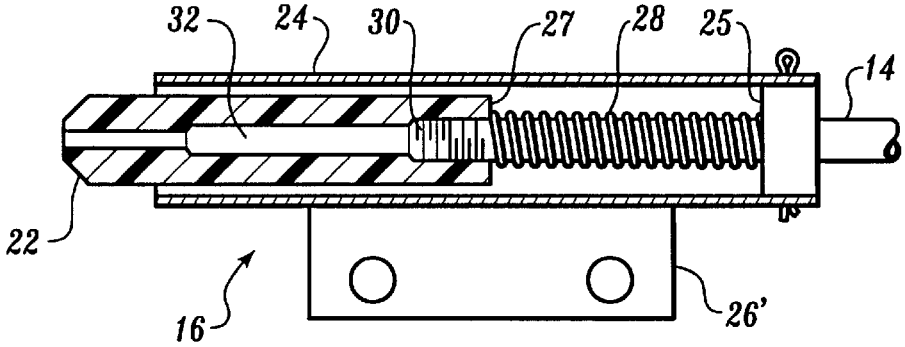
FIG. 4 is a side elevational view of an applicator and nose piece.

FIG. 4 shows applicator 16 in cross section. In this view, applicator 16 is secured in position by a mounting bracket 26' that is attached to housing 24 and has a different shape than fixed mounting bracket 26. Inside housing 24 are disposed nose piece 22 and a hollow spring 28. Lubricant conduit 30 is in fluid communication with lubricant supply array and pump 12 (as shown in FIG. 1) via supply line 14 and is threaded into nose piece 22. Lubricant conduit 30 passes through hollow spring 28 and connects with a fluid channel 32 formed inside of nose piece 22. Fluid channel 32 directs lubricant delivered through supply line 14 onto wheel flange 20 (as shown in FIG. 3). Helical spring 28 is disposed inside housing 24 and provides a biasing force between an inner surface 25 of housing 24 and the internal end 27 of nose piece 22 that ensures nose piece 22 remains seated against wheel flange 20 (as is shown in FIG. 3). However, the force exerted by helical spring 28 is not so great as to cause undue wear between the nose piece and the wheel flange. In addition, nose piece 22 is fabricated from a plastic material such as DELRIN™ or NYLON™ having a low coefficient of friction and excellent wear resistance. Test data have shown that such a nose piece can be expected to have a service life exceeding one year. Preferably, lubricant is delivered to applicator 16 at a pressure sufficient to clear fluid channel 32 of any debris.

Figure 5:
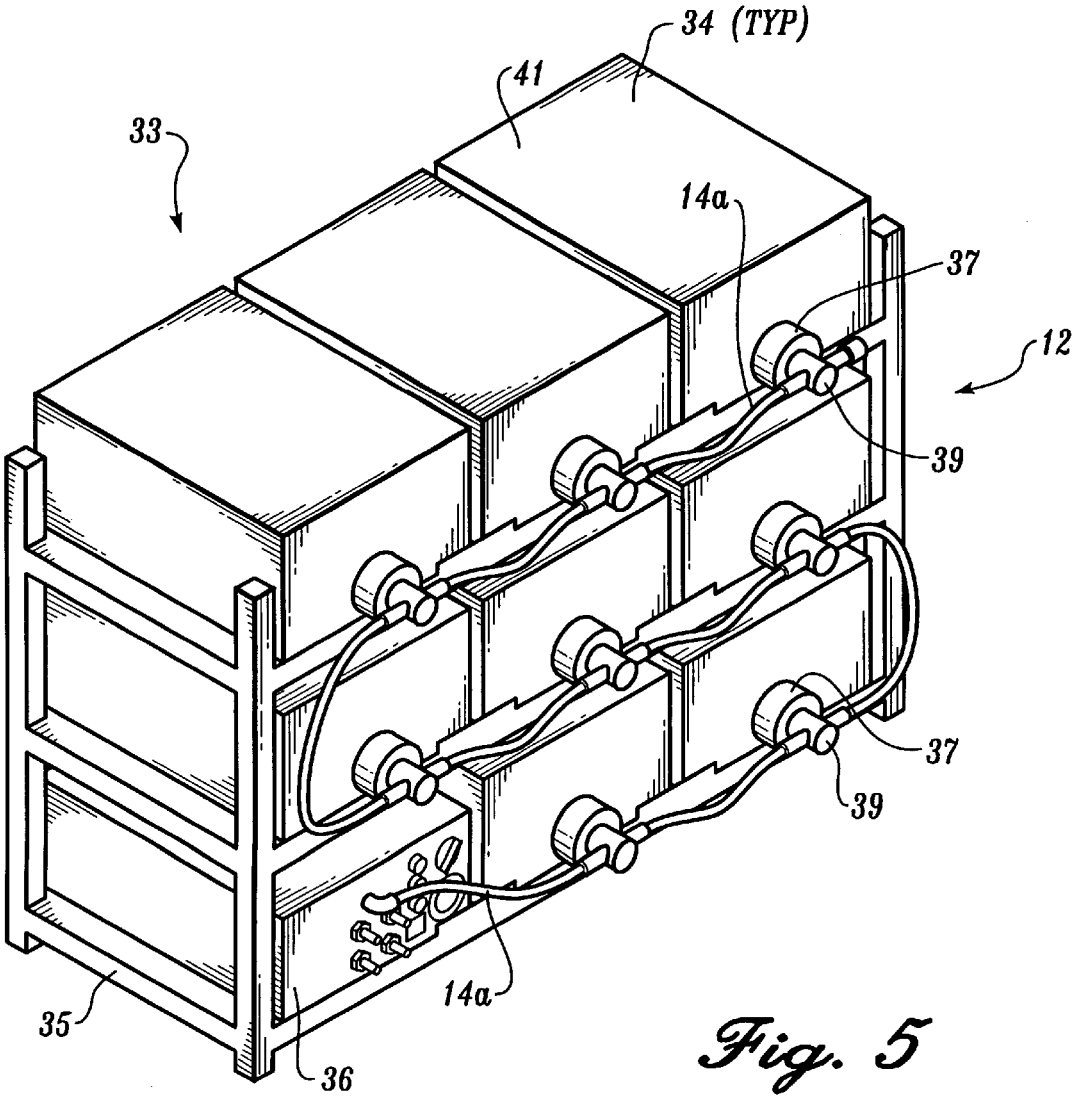
FIG. 5 is a schematic view of the lubrication supply array and pump.

FIG. 5 illustrates a preferred configuration for lubricant supply array and pump 12. Multiple lubricant containers 34 are stacked in a space saving array 33 supported by a frame 35 that minimizes the floor space required. Supply lines 14*a* connect each container 34 in fluid communication with a pump assembly 36. Push/pull valves 37 are fitted on each container 34, and a quick connect T-fitting 39 is attached to the push/pull valves. The quick connect T-fittings are coupled together by supply lines 14*a*. The push/pull valves on a selected container may be closed, allowing that container to be disconnected and removed from service without interrupting the flow of lubricant from other containers 34 through supply lines 14*a* to pump assembly 36. While not shown in detail, a preferred type of container 34 comprises a cardboard box 41 in which is disposed a flexible, collapsible plastic bag to which one push/pull valve 37 is attached in fluid communication. This type of "bag in a box" container is well known in the container art and used for dispensing many different types of liquid products.

Containers 34 that are disposed at the lower elevations in array 33 are emptied prior to the containers that are disposed at the higher elevations. Each container 34 has a capacity of approximately five gallons. Based upon test data that have been accumulated, sufficient lubricant is provided in each container 34 in the preferred embodiment to lubricate the wheels of a locomotive for approximately 4,000 miles of rail travel. Lubricant supply array and pump 12 preferably includes eight containers 34, thereby providing sufficient lubrication for more than 30,000 miles. The total capacity of containers 34 in array 33 is sufficient so that the lubricant supply contained therein should last well beyond the 92-day standard maintenance cycle applicable to long-haul locomotives.

Figure 8:
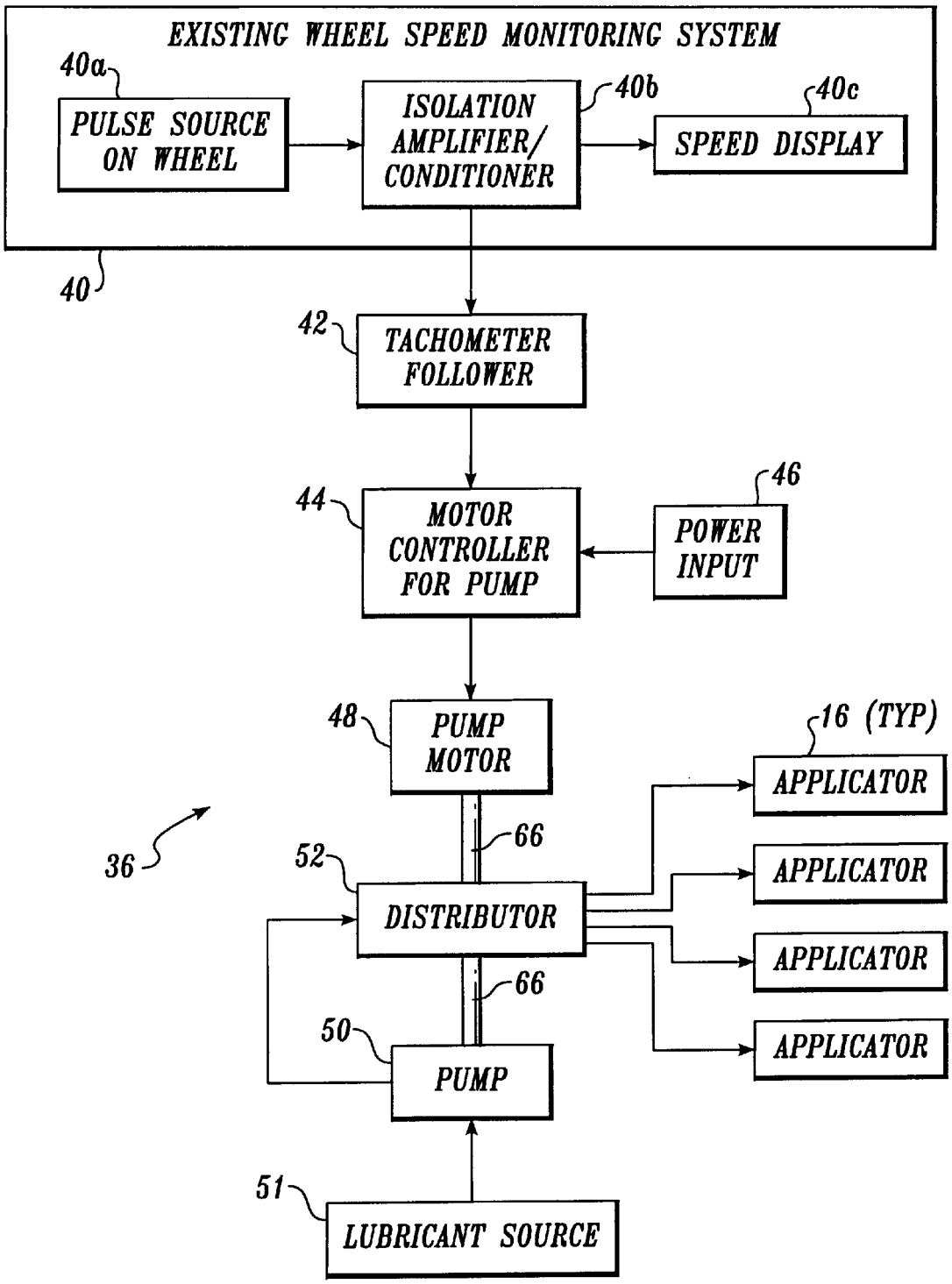
FIG. 8 is a block diagram illustrating the components of a preferred embodiment of the wheel flange lubrication system in accord with the present invention.

As shown in FIG. 8, pump assembly 36 includes a pump motor 48 that serves as a prime mover, a pump 50, which is driven by pump motor 48, and a motor controller 44. The pump motor is energized by a readily available electrical power supply 46 of locomotive 10, controlled by motor controller 44. Pump 50 is in fluid communication with a lubricant source 51.

Most locomotives are fitted with a wheel speed monitoring system 40, to determine the rotational speed of the rail wheels. The wheel speed monitoring system includes a pulse source 40*a* (e.g., optical or magnetic) disposed adjacent to a rail wheel, an isolation amplifier/conditioner 40*b* to amplify and "clean up" or condition the pulse signal produced by the pulse source, and a speed display 40*c*, either analog or digital, to indicate the current speed of the rail wheel being monitored. In the present invention, a signal from isolation amplifier/conditioner 40*b* is applied to a tachometer follower 42, which produces a control signal used to determine the pump speed. The speed of pump motor 48 is controlled by motor controller 44 in response to the control signal supplied by tachometer follower 42 so that the lubricant is applied to the rail wheel flanges at a rate that is proportional to the rolling speed of the rail wheels.

It is envisioned that other criteria may be used to vary the rate at which the lubricant is supplied. For example, it is possible to determine when the train is rounding a curve, and to respond by causing additional lubricant to be applied to the rail wheel flanges, since additional lubrication is beneficial when a train is rounding a curve. It is also contemplated that the rate at which lubrication is applied might be varied in response to ambient temperature or in response to the load on the locomotive. Those of ordinary skill in the art can readily adapt pump assembly 36 to respond to such conditions by using appropriate sensors producing signals that cause motor controller 44 to vary the lubrication rate, as appropriate.

As noted above, in the preferred embodiment, applicators 16 apply lubricant to a rail wheel of locomotive 10 on each side of the locomotive, at both front truck 17 and rear truck 19. Accordingly, a locomotive will preferably have four applicators 16. Pump assembly 36 preferably provides lubricant at a constant pressure to each of four applicators 16. However, as previously mentioned, it is desirable to have lubricant delivered to each applicator 16 at a pressure sufficiently great to clear fluid channels 32 of applicators 16 of any debris. To provide the required pressure simultaneously to all four applicators 16, a high capacity pump can be employed. However, such pumps are relatively expensive, and may require more power than the smaller pump used in the preferred embodiment. Instead of supplying lubricant to all four applicators at the same time, a preferred embodiment includes a fluid sequencer or fluid distributor 52 to distribute the flow of lubricant through supply lines 14 to each applicator 16, so that the lubricant is sequentially supplied to the four applicators. In this manner, a smaller volume pump 50 may be employed in pump assembly 36, while still generating a pressure that is sufficient to remove debris from fluid channels 32 of applicators 16.

Figure 6:
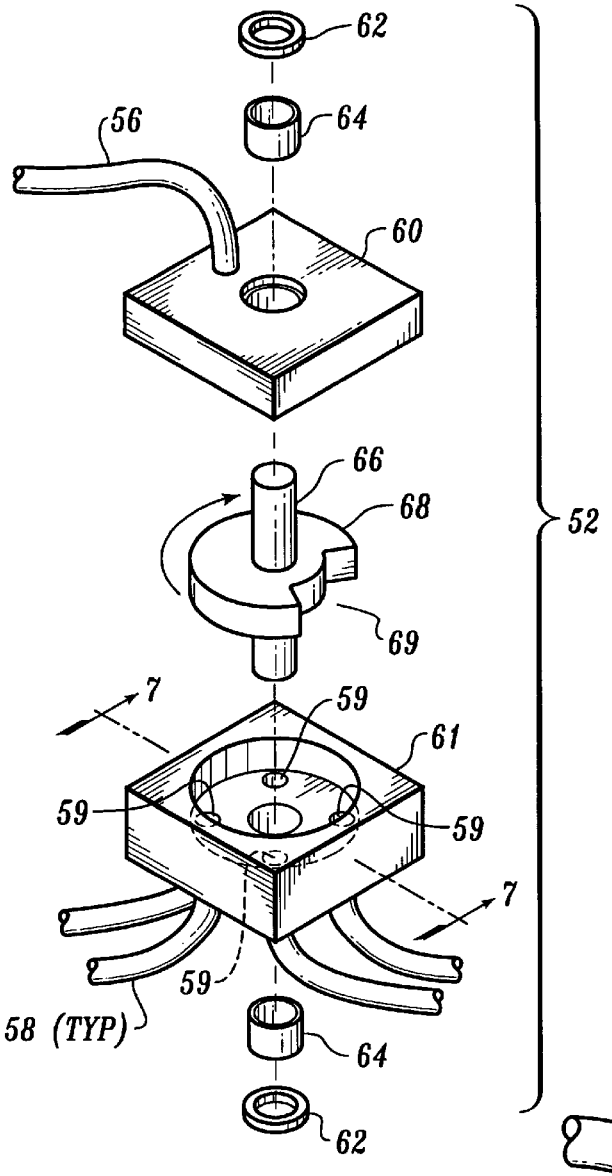
FIG. 6 is an exploded view of a fluid distributor for distributing the lubricant to different wheels on the locomotive.
Figure 7:
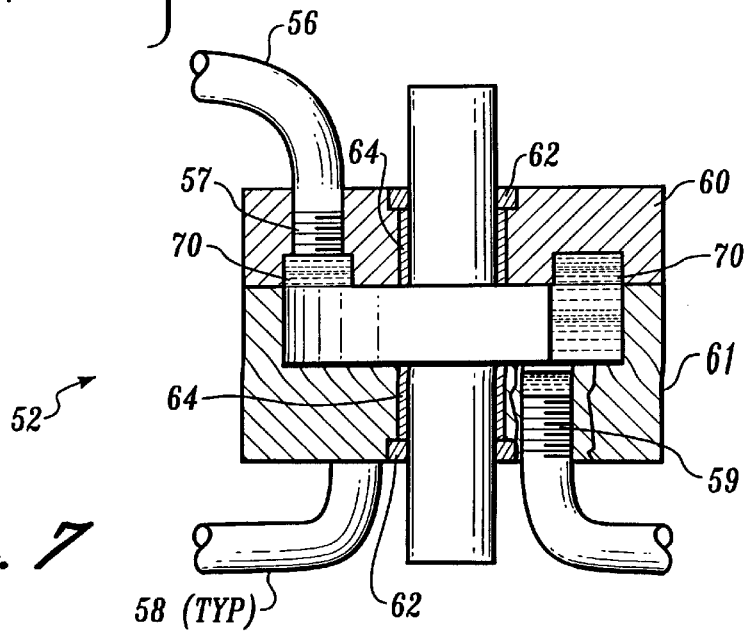
FIG. 7 is cross-sectional view of the distributor taken along section line 7—7 in FIG. 6.

FIGS. 6 and 7 illustrate one preferred embodiment for fluid distributor 52, which is preferably rotatably driven by a shaft 66. Shaft 66 also drivingly connects pump motor 48 to pump 50. Alternatively, a different motor (not shown) may be used to drive distributor 52, with concomitant increased complexity and cost. Distributor 52 sequentially delivers the lubricant flow into separate supply lines 14 that are coupled to each of applicators 16. Lubricant enters distributor 52 through a distributor inlet line 56, which is threaded into an inlet port 57. The lubricant sequentially leaves the distributor through four distributor outlet lines 58, each of which are threaded into a different one of four outlet ports 59. Two of the distributor lines are coupled in fluid communication with applicators 16 mounted adjacent to the rail wheels of front truck 17 of locomotive 10, and two of the distributor lines are coupled to applicators 16 mounted adjacent to the rail wheels of rear truck 19 of locomotive 10.

Fluid distributor 52 includes an upper housing 60, shaft 66, a rotor 68, and a lower housing 61. Rotor 68 is fixedly attached to shaft 66. Two seals 62 prevent lubricant from leaking around shaft 66. Bearings 64 are disposed around shaft 66 in both upper housing 60 and lower housing 61 to ensure that shaft 66 rotates freely. Upper housing 60 is fabricated with an annulus 70 formed around its internal face, as shown in FIG. 7. Rotor 68 includes a cutout area 69, which successively rotates to positions opposite each of outlet lines 58 as the rotor turns; however, the cutout area is always in fluid communication with annulus 70. The rotating cutout area thus sequentially connects inlet line 56 in fluid communication with successive outlet lines 58.

Lubricant enters distributor 52 through inlet line 56, which is in fluid communication with lubricant supply array and pump 12 (shown in FIG. 5). The lubricant flows into annulus 70, and flows through rotor cutout area 69, leaving distributor 52 through outlet port 59 that is exposed to the cutout at that time. Preferably rotor cutout 69 is sized so that no matter what position cutout 69 is in, lubricant will flow through distributor 52 at substantially the rate determined by motor controller 44. Thus, when rotor cutout 69 is in a position such that the passage into one of the four outlet ports is half occluded by rotor 68, the passage into an adjacent outlet port 59 is also half occluded, thereby maintaining a flow rate through the distributor that is substantially independent of the position of rotor 68.

As discussed above, pump assembly 36 can be beneficially employed to vary the lubricant rate of flow in response to selected criteria such as the rotational speed of the rail wheels. Motor controller 44 regulates the power applied to energize pump motor 48 to control the rate at which pump 50 is driven. In the preferred embodiment shown in FIG. 8, the pump and distributor rotate at a rate proportional to the rotational speed of the rail wheels. Pump 50 supplies the lubricant to distributor 52, which in turn distributes it to applicators 16 at a rate determined by the rotational speed of the rail wheels.

As noted earlier, it is envisioned that other parameters may be used to vary the rate at which the lubricant is applied. Curving track, grade, ambient temperature, and heavy loading on the locomotive all may be parameters which may require additional lubricant. Those of ordinary skill in the art will appreciate that the invention can be readily modified to vary the rate at which the lubricant is applied to the wheel flanges as a function of many other parameters in addition to or other than the rotational speed of a rail wheel.

Although the present invention has been described in connection with the preferred form of practicing it, those of ordinary skill in the art will understand that many modifications can be made thereto within the scope of the claims that follow. Accordingly, it is not intended that the scope of the invention in any way be limited by the above description, but instead be determined entirely by reference to the claims that follow.

The invention in which an exclusive right is claimed is defined by the following:

1. A system for applying a lubricant to a rail wheel flange of a rail wheel that rolls along a track, comprising:

(a) a plurality of containers adapted to store a quantity of a lubricant, said plurality of containers being stored in a vertical stack at a plurality of different elevations, and having valves that are connected together in fluid communication by lubricant supply lines;

(b) a pump having an inlet port and outlet port, said inlet port being coupled in fluid communication with said plurality of containers through the lubricant supply lines;

(c) an applicator adapted to be mounted adjacent to a rail wheel flange and connected in fluid communication with the outlet port of the pump; and (d) a prime mover drivingly connected to the pump, said prime mover adapted to apply a driving force to the pump that causes the pump to draw a lubricant from a container that is disposed at a lower elevation in the stack before a lubricant in a container that is disposed at a higher elevation in the stack, and to force a lubricant so drawn through the applicator onto a rail wheel flange, thereby lubricating a rail wheel flange to reduce friction and wear between a rail wheel flange and a side of the track.

2. The system of claim 1, wherein said plurality of containers are sufficient to provide adequate lubrication for a standard maintenance interval of a rail vehicle on which the system is disposed.

3. The system of claim 1, wherein each container comprises a collapsible, flexible bag disposed within a box.

4. The system of claim 1, further comprising additional applicators that are coupled in fluid communication with the outlet port of the pump, said additional applicators being adapted to be mounted adjacent other rail wheel flanges to apply a lubricant to other rail wheel flanges.

5. The system of claim 4, further comprising a fluid distributor that sequentially directs a lubricant from the pump to each applicator in succession.

6. The system of claim 1, further comprising:

(a) a connector adapted to couple to a wheel speed sensor that monitors a rotational speed of a rail wheel along a track, producing a signal indicative of the rotational speed;

(b) a controller coupled to the prime mover and to the connector, said controller being adapted to control a rotational speed of the prime mover in response to the signal indicative of the rotational speed of a rail wheel; and (c) wherein said pump is thereby driven by the prime mover at a speed proportional to the rotational speed of a rail wheel so that a lubricant is applied to a rail wheel flange at a rate proportional to said rotational speed.

7. The system of claim 1, wherein the applicator is adapted to be mounted under a locomotive and to apply a lubricant to a rail wheel flange of a rail wheel mounted on said locomotive.

8. The system of claim 4, wherein the applicators are adapted to mount under a locomotive having a front end and a rear end and adapted to apply a lubricant to a rail wheel flange of at least one rail wheel mounted adjacent to a front end of a locomotive and at least one rail wheel mounted adjacent to a rear end of a locomotive, at least one of said applicators being adapted to be disposed adjacent a front end of a locomotive, and at least one of said applicators being adapted to be disposed adjacent a rear end of a locomotive.

9. The system of claim 8, wherein the applicators are adapted to mount in spaced-apart locations under a locomotive that rides on a pair of spaced-apart parallel rails, and the applicators are further adapted to be used in pairs, such that when one applicator of a pair is adapted to apply a lubricant to a first rail wheel flange of a first rail wheel, a second applicator of the pair is adapted to apply a lubricant to a second rail wheel flange on a second rail wheel that is opposite the first rail wheel.

10. The system of claim 8, further comprising a fixed mounting bracket adapted to mount the applicator on a locomotive having rail wheels turning on tapered roller bearings.

11. The system of claim 8, further comprising a mounting bracket that allows for lateral movement of the applicator and adapted to mount the applicator on a locomotive having rail wheels turning on cylindrical roller bearings.

12. The system of claim 5, further comprising a supply line coupling each applicator in fluid communication with the fluid distributor.

13. The system of claim 1, wherein the applicator comprises a nose piece adapted to deliver a lubricant to a rail wheel flange.

14. The system of claim 13, wherein the nose piece comprises a plastic material.

15. The system of claim 13, wherein the applicator further comprises a spring to bias the nose piece into contact with the rail wheel flange.

16. The system of claim 13, wherein the nose piece includes a fluid channel in fluid communication with the pump outlet.

17. The system of claim 16, wherein the lubricant is delivered to the fluid channel of the applicator at a pressure sufficient to force any debris from said fluid channel.

18. The system of claim 1, further comprising a valve connected to each container, wherein by closing a valve on a specific container, said specific container can be disconnected from fluid communication with the pump and removed without disrupting the flow of a lubricant to the applicator.

19. The system of claim 6, wherein said plurality of containers, the pump, and the controller are adapted to be disposed in a nose compartment of a locomotive.

20. The system of claim 6, wherein said plurality of containers, the pump, and the controller are adapted to be disposed in a generally central compartment of a locomotive.

21. The system of claim 1, wherein said plurality of containers, said lubricant supply lines, said pump, and said applicator are adapted to apply a lubricant comprising a soybean byproduct that is sufficiently viscous to remain on a rail wheel flange and on a side of the track, without migrating to a crown of the track, said lubricant being drawn from said plurality of containers through the lubricant supply lines and forced through a fluid channel to said applicator by said pump.

22. The system of claim 1, wherein said plurality of containers, said lubricant supply lines, said pump, and said applicator are adapted to apply a lubricant comprising a fluid having a viscosity in excess of 20,000 Centistokes, said lubricant being drawn from said plurality of containers through the lubricant supply lines and forced through a fluid channel to said applicator by said pump.

23. A method for lubricating a rail wheel flange of a rail wheel that rolls along a track, during an extended predefined maintenance interval of a train on which the rail wheel is disposed, comprising the steps of:

(a) providing a supply of a fluid lubricant having sufficient viscosity to avoid being flung off the rail wheel flange at normal operating rotational speeds, and to prevent migration of the fluid lubricant from a side of the track onto a crown of the track, the supply of the fluid lubricant comprising a plurality of containers, each container comprising a collapsible, flexible bag disposed within a box, said plurality of containers being coupled together in fluid communication;

(b) storing said plurality of containers in a vertical stack at a plurality of different elevations in an internal compartment of the train in sufficient quantity to enable the lubricant to be continuously applied to the rail wheel flange while the train is moving, without replenishment of the supply during said extended predefined maintenance interval; and (c) pumping the fluid lubricant from the supply onto the rail wheel flange to lubricate the rail wheel flange, minimizing wear between the rail wheel flange and the side of the track along which the rail wheel is rolling, such that a lubricant in a container that is disposed at a lower elevation in the stack is drawn by the pump and applied to a rail wheel flange before a lubricant in a container that is disposed at a higher elevation in the stack.

24. The method of claim 23, wherein the plurality of containers are configured in an array within the internal compartment, on a locomotive.

25. The method of claim 23, wherein the fluid lubricant is biodegradable.

26. The method of claim 23, further comprising the step of applying the fluid lubricant sequentially to a plurality of different rail wheel flanges in succession.

27. The method of claim 23, wherein the fluid lubricant is a soybean derivative.

28. The method of claim 23, further comprising the step of controlling a flow rate of the fluid lubricant onto the rail wheel flange as a function of a rotational speed of said rail wheel.

29. A system for applying a lubricant to a rail wheel flange of a rail wheel that rolls along a track, comprising:

(a) a plurality of containers adapted to store a quantity of lubricant, wherein each container of said plurality of containers comprises a collapsible, flexible bag within a box, said plurality of containers being stored in a vertical stack at a plurality of different elevations;

(b) a pump having an inlet port and outlet port, said inlet port being coupled in fluid communication with said plurality of containers;

(c) an applicator adapted to be mounted adjacent to a rail wheel flange and connected in fluid communication with the outlet port of the pump; and (d) a prime mover drivingly connected to the pump, said prime mover being adapted to apply a driving force to the pump that causes the pump to draw a lubricant from a container that is disposed at a lower elevation in the stack before a lubricant in a container that is disposed at a higher elevation in the stack and to force a lubricant so drawn through the applicator onto a rail wheel flange, thereby lubricating a rail wheel flange to reduce friction and wear between a rail wheel flange and a side of the track.

30. A system for applying a lubricant to a rail wheel flange of a rail wheel that rolls along a tack, comprising:

(a) a plurality of containers adapted to store a quantity of a lubricant, said plurality of containers being stored in a vertical stack at a plurality of different elevation;

(b) a pump having an inlet port and outlet port, said pump inlet port being coupled in fluid communication with said plurality of containers;

(c) a lubricant distributor having an inlet port and a plurality of outlet ports, said inlet port of the distributor being coupled in fluid communication with said outlet port of the pump;

(d) a plurality of applicators, each adapted to be mounted adjacent to a rail wheel flange and connected in fluid communication with a different outlet port of the lubricant distributor; and (e) a prime mover drivingly connected to the pump and to the lubricant distributor, said prime mover applying a driving force to the pump and to the lubricant distributor that causes the pump to draw a lubricant from a container that is disposed at a lower elevation in the stack before a lubricant in a container that is disposed at a higher elevation in the stack, and to force a lubricant so drawn through the lubricant distributor to successively different applicators and onto a rail wheel flange, thereby providing lubrication to reduce friction and wear between a rail wheel flange and a side of the track.

31. A system for applying a lubricant to a plurality of rail wheel flanges of rail wheels that roll along a track, comprising:

(a) a plurality of containers adapted to store a quantity of a lubricant, said plurality of containers being stored in a vertical stack at a plurality of different elevations;

(b) a pump having an inlet port and outlet port, said inlet port of the pump being coupled in fluid communication with said plurality of containers;

(c) a lubricant distributor having an inlet port and a plurality of outlet ports, said inlet port of the lubricant distributor being coupled in fluid communication with said outlet port of the pump, said lubricant distributor being adapted to provide a continuous flow of a lubricant through successive outlet ports of the lubricant distributor;

(d) a plurality of applicators, each applicator being adapted to mount adjacent to a rail wheel flange and being connected in fluid communication with a different one of said plurality of outlet ports of the lubricant distributor; and (e) a prime mover drivingly connected to at least one of said pump and said lubricant distributor, thereby enabling a flow of a lubricant from said plurality of containers, such that a lubricant first flows from a container that is disposed at a lower elevation in the stack before a lubricant flows from a container that is disposed at a higher elevation in the stack, sad lubricant thus drawn flowing through said distributor to successive ones of said plurality of applicators, and onto a rail wheel flange, thereby lubricating a rail wheel flange to reduce friction and wear between a rail wheel flange and a side of the track.

* * * * *